US010415239B2

(12) United States Patent
Schulz-Hanke et al.

(10) Patent No.: US 10,415,239 B2
(45) Date of Patent: Sep. 17, 2019

(54) FACADE ASSEMBLY, BUILDING CONSTRUCTION AND METHOD FOR MOUNTING THE FACADE ASSEMBLY

(71) Applicant: HILTI AKTIENGESELLSCHAFT, Schaan (LI)

(72) Inventors: Wolfang Schulz-Hanke, Untermeitingen (DE); Stefan Juli, Bludenz (AT); Johann Huber, Augsburg (DE); Rene Hennig, Meissen (DE); Sebastian Simon, Buchloe Lindenberg (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 15/760,849

(22) PCT Filed: Sep. 14, 2016

(86) PCT No.: PCT/EP2016/071639
§ 371 (c)(1),
(2) Date: Mar. 16, 2018

(87) PCT Pub. No.: WO2017/046127
PCT Pub. Date: Mar. 23, 2017

(65) Prior Publication Data

US 2018/0258634 A1 Sep. 13, 2018

(30) Foreign Application Priority Data

Sep. 17, 2015 (EP) ..... 15185579

(51) Int. Cl.
*E04B 1/94* (2006.01)
*E04B 2/88* (2006.01)

(52) U.S. Cl.
CPC ..... *E04B 1/948* (2013.01); *E04B 2/88* (2013.01)

(58) Field of Classification Search
CPC ..... E04B 1/94; E04B 1/941; E04B 1/948; E04B 2/88; E04B 2/885
See application file for complete search history.

(56) References Cited

U.S. PATENT DOCUMENTS 3,786,604 A * 1/1974 Kramer ..... E04B 1/6801 52/232
4,449,341 A * 5/1984 Taglianetti ..... E04B 2/88 52/235

(Continued)

FOREIGN PATENT DOCUMENTS

FR 3 001 984 A1 8/2014
JP H07-42271 2/1995

(Continued)

OTHER PUBLICATIONS

International Search Report issued in PCT/EP2016/071639, with English Translation, dated Nov. 17, 2016.

(Continued)

*Primary Examiner* — Adriana Figueroa
*Assistant Examiner* — Jessie T Fonseca
(74) *Attorney, Agent, or Firm* — Grüneberg and Myers PLLC

(57) ABSTRACT

A facade assembly which is suitable for a building includes: at least one facade element, which can be secured to a story outer edge of the building, and at least one fire-protection element, which is installed between the facade element and the story outer edge, where the fire-protection element contains an insulating layer and a fire-protection mat, where the insulating layer has a first side face facing the facade element and a second side face, which is disposed opposite the first side face and faces the story outer edge, and a bottom face, which extends between the first and second side face, and where the fire-protection mat wraps around the (Continued)

bottom face of the insulating layer and bears against at least one part of the first and second side face.

17 Claims, 2 Drawing Sheets

(56) References Cited

U.S. PATENT DOCUMENTS 5,765,332 A * 6/1998 Landin ..... E04B 1/948 52/235
5,974,750 A 11/1999 Landin et al.
7,240,905 B1 * 7/2007 Stahl, Sr. ..... E04B 1/681 277/652
7,856,775 B2 * 12/2010 Stahl, Jr. ..... E04B 2/88 52/1
8,671,645 B1 * 3/2014 Shriver ..... E04B 2/88 156/71
8,683,763 B2 * 4/2014 Shriver ..... E04B 2/96 52/235
8,793,946 B2 * 8/2014 Stahl, Jr. ..... E04B 2/96 52/1
2007/0204540 A1 * 9/2007 Stahl, Sr. ..... E04B 1/94 52/274
2010/0024336 A1 * 2/2010 Stevenson ..... B32B 18/00 52/309.13
2012/0180414 A1 * 7/2012 Burgess ..... E04B 2/90 52/300
2013/0091789 A1 * 4/2013 Simon ..... E04B 1/944 52/220.8
2014/0144093 A1 5/2014 Shriver
2015/0159368 A1 * 6/2015 Green ..... C09D 5/185 52/232
2017/0183863 A1 * 6/2017 Foerg ..... E04B 1/6801

FOREIGN PATENT DOCUMENTS

JP 2002-242334 8/2002
JP 2011-196093 10/2011
JP 2012-225082 11/2012
WO WO96/026332 A1 6/1996

OTHER PUBLICATIONS

Written Opinion of the International Searching Authority issued in PCT/EP2016/071639, dated Nov. 17, 2016.

* cited by examiner

FACADE ASSEMBLY, BUILDING CONSTRUCTION AND METHOD FOR MOUNTING THE FACADE ASSEMBLY

This application is a National Stage entry under § 371 of International Application No. PCT/EP2016/071639, filed on Sep. 14, 2016, and which claims the benefit of European Patent Application No. 15185579.8, filed on Sep. 17, 2015.

The invention relates to a facade assembly for a building with at least one facade element, which can be fastened to a story outer edge of the building, and with at least one fire-protection element, which can be installed between the facade element and the story outer edge. The invention further relates to a building structure using the facade assembly and to a method for mounting such a facade assembly.

Curtain facades comprising individual facade elements, which are fastened to a shell of a building, are frequently used in the building sector. The shell may be manufactured in skeleton form and the facade elements constitute the exterior skin of the building, in which case the facade elements take over the function of a wall construction. The individual facade elements usually have a substructure, for example a framework, by means of which the facade elements are fastened to the shell. These facade elements bear only their own weight and have no static functions. However, the facade elements may take over insulating functions as well as stylistic functions for the exterior skin.

On the back side, the facade elements have a cladding, which consists of metal, such as steel sheet, for example. Joints sealed by insulating material, comprising mineral wool in the prior art, are present between the shell and the facade elements, in order to prevent propagation of fire behind the facade elements in the fire situation. These insulating elements are disposed on a story outer edge at the height of the inter-story ceilings, so that spreading of the fire from one story to another story is prevented, in which case the fire-protection elements are also able to take over further insulating functions, such as sound protection, for example.

Especially for facade elements with a metal cladding on the back side, large deformations of the cladding and thus of the facade elements may occur in the fire situation. These deformations may cause the joint between the story outer edge on the wall or the ceiling and the facade element to become so large that the insulating element of compressed mineral wool is no longer able to fill the joint between the facade element and the story outer edge completely and seal it against fire or smoke.

In addition, the enlargement of the joint may cause the insulating element to lose its connection to the facade element and the story outer edge partly or completely and, because of its own weight, to increase the size of the joint further by tilting or falling down. Thereby penetration of fire or smoke into the story located above is further favored.

In the prior art, it has previously been the practice, in order to compensate for a joint that becomes larger in the fire situation, to close the joint between the facade element and the story outer edge with compressed mineral wool and to apply a coating, whereby fire or smoke is supposed to be prevented from penetrating into the story located above. In this case the facade elements may be additionally stiffened by introduction of a profile on the side of the cladding facing away from the shell. Thus the profile is not provided between the facade element and the story outer edge, but instead is positioned inside the facade element. This mechanical stiffening is intended to prevent deformation of the facade element in the fire situation.

From U.S. Pat. No. 7,856,775 B2, it is known to fix an additional mineral-wool block on the cladding underneath the insulating element filling the joint. The additional mineral-wool block is intended to close the gap that develops in the fire situation.

Nevertheless, considerable work effort is necessary for mounting the prior-art fire-protection elements. The attachment of the additional mineral-wool block or of the profile additionally necessitates tasks at ladder height in the story underneath the insulating element and thus leads to a higher risk of injury as well as additional time requirements.

The object of the invention is to provide a facade assembly that permits better sealing of the joint between facade element and the story outer edge in the fire situation and thus provides better fire protection.

To solve the object, a facade assembly for a building is provided, with at least one facade element, which can be fastened to a story outer edge of the building, and with at least one fire-protection element, which is installed between the facade element and the story outer edge, wherein the fire-protection element comprises an insulating layer and a fire-protection mat, wherein the insulating layer has a first side face facing the facade element and a second side face which is disposed opposite the first side face and faces the story outer edge, and a bottom face, which extends between the first and second side face, and wherein the fire-protection mat wraps around the bottom face of the insulating layer and bears against at least one part of the first and second side face. By the fact that the fire-protection mat surrounds the insulating layer in the mounted condition on its bottom side, it shields this from possible heat exposure during a fire and thus protects the insulating layer from intensified volume reduction and accelerated loss of the retention force induced in the mineral wool by compression.

In an alternative embodiment of the inventive facade assembly, the fire-protection mat wraps around the insulating layer completely, so that all sides of the insulating layer are surrounded by the fire-protection mat. This further facilitates the installation of the fire-protection element.

In contrast to a fire-protection system with intumescent fire-protection elements, the insulating layer at the face of contact with the facade element and the story outer edge on the wall or the inter-story ceiling of the building is not compressed by the fire-protection mat and also does not burn away.

The facade element is known in principle from the prior art. Preferably the facade element is designed as a curtain facade, with a frame construction, preferably of steel or aluminum, an outer covering, which is joined to the frame construction and may be formed from glass, ceramic, metal or natural stone. Cladding, preferably formed from steel sheet, is provided on the back side of the covering, which in the installed condition faces the building. An insulating layer, for example of mineral wool or foam, may be provided between the exterior covering and the cladding.

Preferably the fire-protection mat has at least one frayed or irregular rim portion. A frayed rim portion offers a larger surface area, which may be utilized for interactions between the fire-protection mat and the story outer edge and/or the facade element and thus may lead to improved adhesion.

The frayed rim portion may preferably bear against the facade element and/or against the story outer edge. This configuration acts advantageously on the surface contact of the fire-protection mat with the facade element and the story outer edge, since the fire-protection mat is then also able to conform optimally to uneven faces of the substrate and be pressed by the insulating layer into small irregularities formed in the fire situation. In this way the imperviousness is enhanced and especially smoke and hot gases are held in check better.

According to a further embodiment, the fire-protection mat has two rim portions disposed opposite one another, wherein respectively one rim portion of the fire-protection mat is inserted into the first or the second side face of the insulating layer when this is installed between the facade element and the story outer edge. Thereby an at least partial connection of the fire-protection mat to the insulating layer is achieved. In this way it is possible to prevent the fire-protection mat from detaching from the insulating layer. An additional advantage of this embodiment is that the insulating layer together with fire-protection mat can be offered and processed as an assembly, thus entailing further advantages both in logistics and also for installation on site.

Preferably a clearance is provided between the bottom face of the insulating layer and the fire-protection mat. The fire-protection mat sags, so to speak, without tensile stress. Thereby the fire-protection mat can easily follow any movement of the facade element if it becomes deformed in the fire situation. Sealing of the joint between facade element and story outer edge by the insulating layer is thus further improved.

According to a preferred embodiment, the insulating layer is a mineral-wool insulating layer, which by virtue of its properties is particularly well suited for the purpose of an insulating layer in fire protection and furthermore is favorable from the economic viewpoint. Particularly preferably, the insulating layer consists of compressed mineral wool. Preferably the fire-protection mat is formed from one or more of the following materials: glass fibers, silicon fibers, calcium magnesium silicate fibers, mineral fibers on the basis of $SiO_2$ and CaO, basalt fibers, ceramic fibers such as fibers of boron carbide/silicon nitride, stainless steel and coated flexible inorganic fibers that have a melting point of higher than 1200° C., as well as textile materials made from these fibers, such as woven fabrics, knit fabrics and nonwovens, which may be coated or uncoated. Particularly preferred are glass-fiber fabrics, silicone-coated glass-fiber fabrics, fabrics made from silicon fibers, a temperature-stabilized glass-fiber fabric, which very largely retains its tensile strength in the presence of thermal stresses, such as the Thermo-Eglass fabric made from filaments or from textured yarns of HKO Isolier- und Textiltechnik GmbH with and without reinforcement comprising stainless-steel wire such as V4A wire, which compared with normal glass fibers has greater tensile strength and better high-temperature behavior, high-temperature-resistant needled mats and silicone-coated stainless-steel wire fabrics as well as mixed fabrics made from the said materials and additionally also inorganic fibers of boron carbide/silicon nitride. By virtue of their temperature resistance and their behavior at high temperatures, these materials are particularly well suited as material for the fire-protection mat.

The fire-protection mat may preferably have a coating of at least one of the following materials: ceramic coatings, silicate coatings, metal oxide coatings as well as silicone coatings, especially silicone/topcoat (one or both sides coated with silicone rubbers, has high loadabilities even under extreme mechanical, thermal and electrical influences; e.g. HKO Isolier- und Textiltechnik GmbH), transfer silicone (coating in the transfer process; e.g. HKO Isolier- und Textiltechnik GmbH) and high-temperature silicone (coating with a special silicone rubber for improved temperature resistance; e.g. HKO Isolier- und Textiltechnik GmbH). These coatings improve the properties of the fire-protection mat at high temperatures and permit adhesion of the fire-protection mat to the facade element and the story outer edge before, during and after a fire.

Particularly preferably, the fire-protection mat does not contain any intumescent materials. The insulating layer will then not be compressed against the boundary face with the facade element and/or the story outer edge by the expanding intumescent material in the fire situation, and also cannot burn away.

Preferably, the fire-protection mat is fastened on the facade element and the story outer edge. Especially adhesive bonding, clamping, bolting or nailing are suitable for fastening, as are also any other method known to the person skilled in the art from the prior art as suitable for this purpose. A fire-protection mat fastened in this way moves to some extent together with the facade element being deformed by the fire and thus is able to cover the resulting gap reliably. Thus the fastening of the fire-protection mat leads to improved fire-protection properties, even under high stresses and strains.

Water glass, fireclay mortar and fireclay adhesive, furnace adhesive, liquid ceramics and low-melting fire-protection coatings, for example of acrylate and zinc borate, may be used as adhesives for fastening the fire-protection mat to the facade element and/or the story outer edge, as can glass coatings that likewise act as adhesives at the temperature occurring in the fire situation.

In one advantageous embodiment, the fire-protection mat is formed from elastic fibers and is fastened under preload between the facade element and the story outer edge. This configuration permits rapid, simple and cost-effective mounting, since additional fastening means can be largely dispensed with. At the same time, the advantageous properties, to the effect that the fire-protection mat is fastened between the facade element and the story outer edge and adapts to changes in the facade geometry, can be preserved.

According to a further advantageous embodiment, the facade element and the story outer edge are metallic and the fire-protection mat is fastened by magnetic force to the facade element and/or the story outer edge. This embodiment likewise permits rapid, simple and cost-effective mounting, in which additional fastening means can be largely dispensed with. Moreover, this embodiment also exhibits the advantageous properties, to the effect that the fire-protection mat is fastened between the facade element and the story outer edge and adapts to changes in the facade geometry. Alternatively, the fire-protection mat may be a metal, in the form, for example, of a strip or of metal fibers incorporated into the fire-protection mat, and the story outer edge and/or the facade element may contain magnetic strips.

Further subject matter of the invention is a building structure, with at least one story outer edge and at least one facade element, which can be fastened to the story outer edge of the building, wherein a joint is formed between the facade element and the story outer edge, and with at least one fire-protection element, which is installed in the region of the joint between the facade element and the story outer edge, wherein the fire-protection element comprises an insulating layer and a fire-protection mat, wherein the insulating layer has a first side face facing the facade element and a second side face, which is disposed opposite the first side face and faces the story outer edge, and a bottom face, which extends between the first and second side face, wherein the fire-protection mat wraps around the insulating layer at its bottom face and bears against at least one part of the first and second side face.

The facade element and the fire-protection element form the above-described facade assembly to which reference is made.

The object is further solved by a method for mounting a facade assembly for a building, with at least one facade element, which is fastened to a story outer edge of the building, and with at least one fire-protection element, which is mounted between the facade element and the story outer edge, wherein the fire-protection element comprises an insulating layer and a fire-protection mat, with the following steps:

attachment of the facade element to the story outer edge of the building, wherein a joint is formed between the facade element and the story outer edge, and introduction of the fire-protection element into the joint between the facade element and the story outer edge of the building, so that the fire-protection mat is disposed on a bottom face of the insulating layer and wraps around the insulating layer at the bottom face, and that the fire-protection mat bears at least partly against the facade element and the story outer edge.

Preferably the fire-protection element together with the insulating layer and the fire-protection mat is inserted on the floor side into the joint between the facade element and story outer edge. In the process, the fire-protection element may be inserted from above into the joint in parts in succession or in one piece as an assembly and in one step on the floor level of the inter-story ceiling. In this case, the fire-protection element points downward, i.e. in the direction of the story located under the inter-story ceiling. In this way the fire-protection element can be fastened simply and safely, and it permits installation without necessitating overhead work from the story located under the inter-story ceiling.

Further advantages and features will become obvious from the description hereinafter in conjunction with the attached drawings, wherein.

Figure 1:
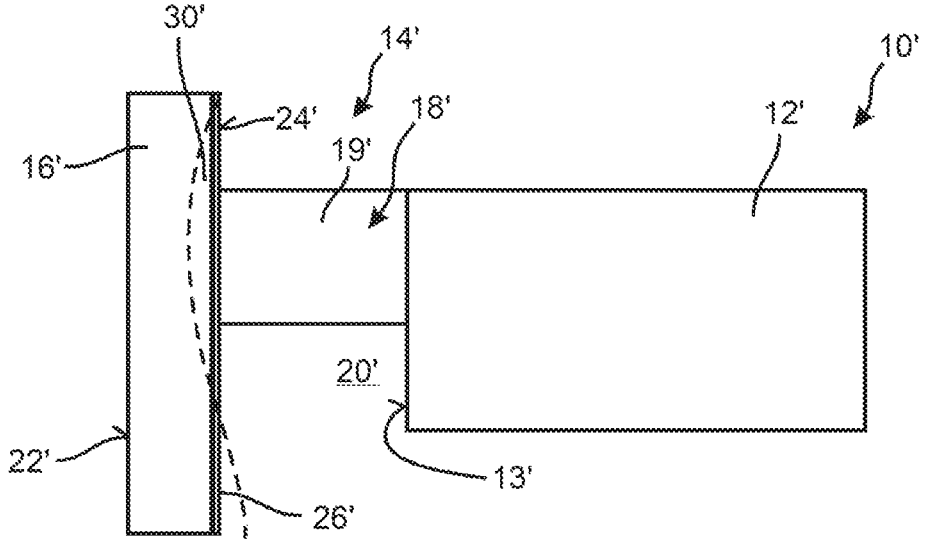
FIG. 1 shows a sectional view through a building with a facade assembly according to the prior art.

FIG. 1 shows a section of a building 10' with an inter-story ceiling 12'. A facade assembly 14' is hung in curtain style on story outer edge 13' of building 10'.

Facade assembly 14' consists of a facade element 16' as well as a fire-protection element 18', which is disposed in a joint 20' between story outer edge 13 of inter-story ceiling 12' and facade element 16'. Fire-protection element 18' consists here of an insulating layer 19', for example of mineral wool, preferably compressed mineral wool.

Facade element 16' forms an exterior wall construction or the facade of building 10' and has a substructure, not illustrated in detail here, for example a framework, on which the individual elements of the exterior facade, for example wall elements, windows as well as insulating layers, are retained. The substructure serves for fastening of facade elements 16' on building 10'.

Facade assembly 14' serves stylistic purposes and/or protection of building 10', wherein exterior side 22' of such a facade element 16' can be configured in any desired manner, especially as a function of viewpoints related to style and/or building physics. As an example, exterior side 22' may have elements of glass, ceramic, metal or other suitable materials.

In most cases, facade assembly 14' or facade elements 16' bear only their own weight and have no static function for building 10'. However, structures are also known in which the facade assembly or the facade elements are load-bearing and thus fulfill a static function for the building.

On back side 24' of facade element 16' facing building 10', cladding is provided, which may be part of the interior wall of building 10' and consists here of steel sheet 26'. This steel sheet 26' may be part of the substructure or may form merely the interior closure of facade element 16'.

By virtue of fire-protection element 18' provided between story outer edge 13' and facade element 16' penetration of smoke and fire from a region below inter-story ceiling 12' into the region above inter-story ceiling 12' in the fire situation is prevented, and so the propagation of a fire can be prevented or at least slowed.

Due to the high temperatures occurring during a fire, however, deformation of facade element 16', especially of steel sheet 26', may occur (see dashed line in FIG. 1). This deformation may cause a gap 30', through which penetration of smoke or fire is possible, to develop between fire-protection element 18' and facade element 16'. This means that fire-protection element 18' is not able to fulfill its fire-protection function completely if facade element 16' becomes badly deformed.

Figure 2:
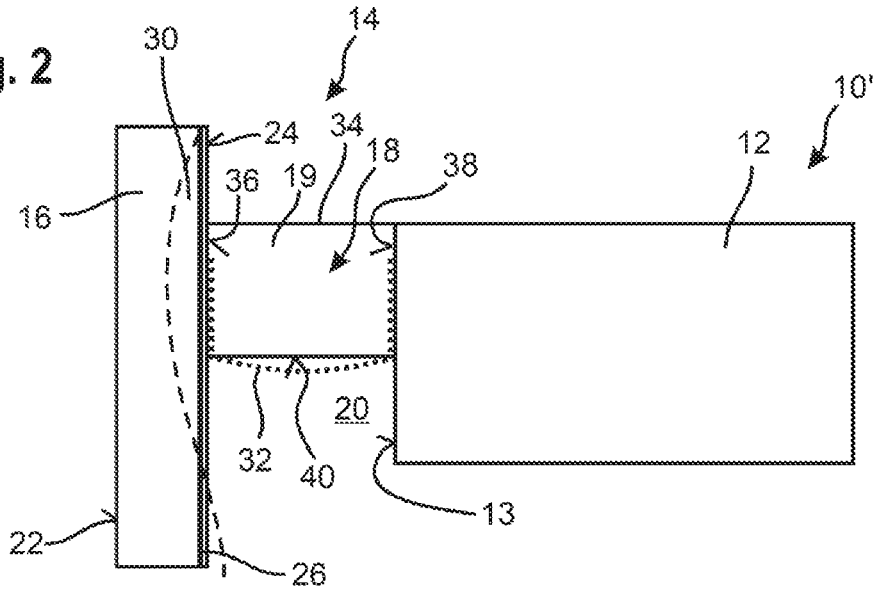
Prior art Fig. 2
FIG. 2 shows a sectional view through a building with a first embodiment of an inventive facade assembly.

In order to eliminate this disadvantage, facade assembly 14 shown in FIG. 2 is provided. The basic design of building 10 with an inter-story ceiling 12 as well as facade element 16 hung in curtain style on story outer edge 13 corresponds substantially to the design shown in FIG. 1. As a supplement to insulating layer 19, however, fire-protection element 18 additionally has a fire-protection mat 32.

Insulating layer 19 is a block in the form of a cuboid with a top side 34, two side faces 36, 38 disposed opposite one another and a bottom face 40. Alternatively, the block may also be composed of the same or different mineral-wool strips. In the installed condition, a first side face 36 points in the direction of facade element 16 and side face 38 disposed on the other side points in the direction of story outer edge 13 disposed opposite facade element 16. In the installed condition, top side 34 of insulating layer 19 points in the direction of the room, located above inter-story ceiling 12 and having a floor formed by inter-story ceiling 12, and bottom face 40 extending between side faces 36, 38 points in the direction of a room located under inter-story ceiling 12.

Fire-protection mat 32 wraps around insulating layer 19 on its bottom face 40 in the installed condition and bears on at least part of side faces 36, 38 between insulating layer 19 and facade element 16 as well as insulating layer 19 and story outer edge 13. However, fire-protection mat (32) may also extend over the entire height of the first and/or second side face 36, 38.

In this connection, fire-protection mat 32 is able to sag distinctly, so that a clearance between fire-protection mat 32 and insulating layer 19 is present at least in a middle portion of fire-protection mat 32, in order that, in the event of deformation of facade element 16, it is able to cover joint 20, which becomes larger as a result, without becoming stretched.

In a further embodiment (not illustrated), fire-protection mat 32 may wrap around the bottom face of insulating layer 19 and bear on the entire first and second side face 36, 38.

Figure 3:
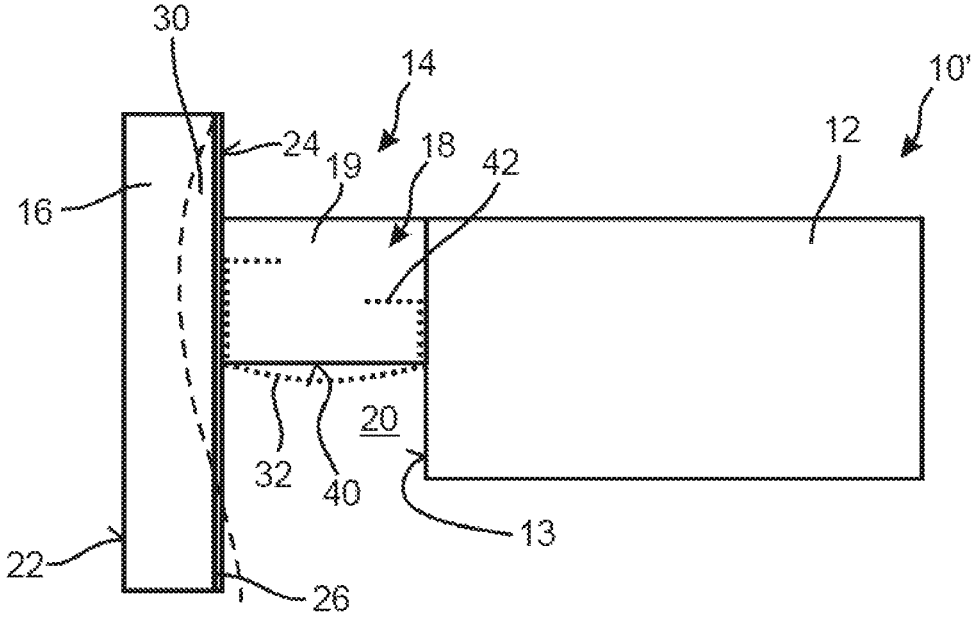
FIG. 3 shows a sectional view through a building with a second embodiment of an inventive facade assembly.

A second embodiment of an inventive facade assembly 14, which corresponds substantially to the design shown in FIG. 2, is shown in FIG. 3. As a difference from the first embodiment shown in FIG. 1, fire-protection mat 32 has two rim portions 42 that are disposed opposite one another and inserted into side faces 36, 38 of insulating layer 19.

For this purpose, at least one slot, in which fire-protection mat 32 engages with its rim portions 42, may be provided in fire-protection mat 32 at side faces 36, 38 respectively facing facade element 16 and story outer edge 13. Preferably rim portions 42 may be fastened respectively in the slot, for example by adhesive bonding or frictional locking.

Rim portions 42 may comprise the entire rim of fire-protection mat 32 or else only partial portions thereof, which then engage in portions in insulating layer 19 or bear against the outside of insulating layer 19.

Figure 4:
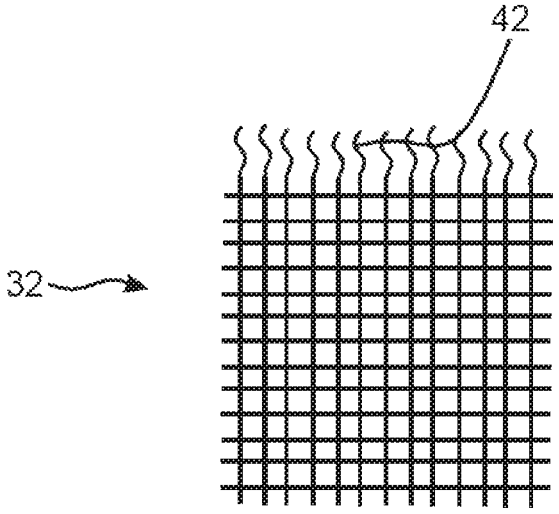
FIG. 4 shows an overhead view of a schematic fire-protection course for an inventive facade assembly.

FIG. 4 shows an embodiment of fire-protection mat 32 that is frayed along at least one rim portion 42. However, fire-protection mat 32 may also be frayed along two rim portions disposed opposite one another (not shown here). As shown in the embodiments illustrated in FIG. 2 and FIG. 3, for example, frayed rim portions 42 may be disposed between insulating layer 19 and facade element 16 or inter-story ceiling 12, in order to assure better surface contact. In this case, only one of the rim portions 42 may be frayed, while the other rim portion 42 is substantially formed to be smooth, or else both oppositely disposed rim portions 42 may be frayed.

In all embodiments, rim portions 42 may be joined frictionally, interlockingly and/or by substance-to-substance bond with insulating layer 19.

Fire-protection mat 32 may be formed from one of the following materials: glass fibers, silicon fibers, calcium magnesium silicate fibers, mineral fibers on the basis of $SiO_2$ and CaO, basalt fibers, ceramic fibers such as fibers of boron carbide/silicon nitride, stainless steel and coated flexible inorganic fibers that have a melting point of higher than 1200° C., as well as textile materials made from these fibers, such as woven fabrics, knit fabrics and nonwovens, which may be coated or uncoated. Particularly preferred are glass-fiber fabrics, silicone-coated glass-fiber fabrics, fabrics made from silicon fibers, temperature-stabilized glass-fiber fabric, which very largely retains its tensile strength in the presence of thermal stresses, such as the Thermo-E-glass fabric made from filaments or from textured yarns of HKO Isolier- und Textiltechnik GmbH with and without reinforcement comprising stainless-steel wire such as V4A wire, high-temperature-resistant needled mats and silicone-coated stainless-steel wire fabrics as well as mixed fabrics made from the said materials and additionally also inorganic fibers of boron carbide/silicon nitride. In principle, however, all materials are suitable that have sufficient strength as well as fire-protection properties, such as high-temperature resistance and the ability to form an ash crust, corresponding to the materials mentioned hereinabove. Intumescent materials are not desired for this purpose, since they compress insulating layer 19 and in this way may impair the fire-protection properties.

Fire-protection mat 32 may also have a coating of at least one of the following materials: ceramic coatings, silicate coatings, metal oxide coatings as well as silicone coatings, especially silicone/topcoat (one or both sides coated with silicone rubbers, has high loadabilities even under extreme mechanical, thermal and electrical influences; e.g. HKO Isolier- und Textiltechnik GmbH), transfer silicone (coating in the transfer process; e.g. HKO Isolier- und Textiltechnik GmbH) and high-temperature silicone (coating with a special silicone rubber for improved temperature resistance; e.g. HKO Isolier- und Textiltechnik GmbH). Such a coating may improve the adhesion of fire-protection mat 32 to facade element 16 and story outer edge 13.

In an embodiment not illustrated here, fire-protection mat 32 is fastened to facade element 16 and/or story outer edge 13, especially by adhesive bonding, clamping, bolting or nailing. Furthermore, fire-protection mat 32 may also be anchored mechanically, chemically or physically in other ways. Additional mechanical anchoring may be achieved, for example, by rivets or brackets. Physical anchoring may be achieved by frictional connection.

Water glass, fireclay mortar and fireclay adhesive, furnace adhesive, liquid ceramics and low-melting fire-protection coatings, for example of acrylate and zinc borate, may be used as adhesives for fastening the fire-protection mat to the facade element and/or the story outer edge, as can glass coatings that likewise act as adhesives at the temperature occurring in the fire situation.

In a further embodiment (not illustrated), fire-protection mat 32 is formed from elastic fibers and is fastened under preload between facade element 16 and story outer edge 13. In the process, additional fastening means may be dispensed with for fastening fire-protection mat 32.

In a further embodiment, not illustrated, facade element 16 and story outer edge 13 are metallic. In this case, fire-protection mat 32 has magnetic fibers, with which it can be fastened on facade element 16 and story outer edge 13.

The invention achieves safe and reliable sealing of facade element 16 if it becomes deformed in the fire situation, and fire-protection element 32 of the inventive facade assembly 14 may be mounted by working solely at floor level. Moreover, prefabricated assemblies of insulating layer 19 and fire-protection mat 32 may be provided. The work effort for mounting facade assembly 14 is therefore greatly reduced.

The invention claimed is:

1. A facade assembly for a building, comprising:

at least one facade element, which can be secured to a story outer edge of the building, and at least one fire-protection element, which is installed between the facade element and the story outer edge, wherein the fire-protection element comprises an insulating layer and a fire-protection mat, wherein the insulating layer has a first side face facing the facade element and a second side face, which is disposed opposite the first side face and faces the story outer edge, and a bottom face, which extends between the first and second side face, and wherein the fire-protection mat wraps around the bottom face of the insulating layer and bears against at least one part of the first and second side face wherein the fire-protection mat has at least one frayed rim portion.

2. The facade assembly according to claim 1, wherein the frayed rim portion bears against the at least one facade element and/or the story outer edge.

3. The facade assembly according to claim 1, wherein the fire-protection mat has two rim portions disposed opposite one another, wherein one of the rim portions engages in the first side face and the other rim portion engages in the second side face.

4. The facade assembly according to claim 1, wherein the insulating layer is a mineral-wool insulating layer.

5. The facade assembly according to claim 1, wherein the fire-protection mat comprises a coating of at least one member selected from the group consisting of a ceramic coating, a silicate coating, a metal oxide coating, and a silicone coating.

6. The facade assembly according to claim 1, wherein the fire-protection mat is fastened to the facade element and the story outer edge.

7. The facade assembly according to claim 1, wherein the fire-protection mat is magnetic and at least one member selected from the group consisting of the facade element the story outer edge is metallic, wherein the fire-protection mat is fastened by magnetic force to at least one member selected from the group consisting of the facade element and the story outer edge.

8. The facade assembly according to claim 1, wherein the fire-protection mat completely surrounds the insulating layer.

9. The facade assembly according to claim 1, wherein the fire-protection mat comprises an elastic material and is fastened under preload between the facade element and the story outer edge.

10. The facade assembly according to claim 1, wherein the fire-protection mat is disposed at a distance from the bottom face of the insulating layer.

11. A building structure, comprising:

a facade assembly according to claim 1, at least one story outer edge, and at least one facade element, which can be fastened to the story outer edge of the building, wherein a joint is formed between the facade element and the story outer edge, and comprises at least one fire-protection element, which is installed in the region of the joint between the facade element and the story outer edge, wherein the fire-protection element comprises an insulating layer and a fire-protection mat, wherein the insulating layer has a first side face facing the facade element and a second side face, which is disposed opposite the first side face and faces the story outer edge, and a bottom face extending between the first and second side face, and wherein the fire-protection mat wraps around the insulating layer at the bottom face and bears against at least one part of the first and second side face.

12. A method for mounting a facade assembly according claim 1, the method comprising:

attaching the facade element to the story outer edge of the building, wherein a joint is formed between the facade element and the story outer edge, and introducing the fire-protection element into the joint between the facade element and the story outer edge of the building, so that the fire-protection mat wraps around the insulating layer at a bottom face, and so that the fire-protection mat bears at least partly against the facade element and the story outer edge.

13. The method according to claim 12, wherein the fire-protection element is inserted on a floor side into the joint between the facade and the story outer edge.

14. The facade assembly according to claim 1, wherein the fire-protection mat is fastened to the facade element and the story outer edge by adhesive bonding, clamping, bolting, or nailing.

15. The facade assembly according to claim 1, wherein the fire-protection mat comprises at least one member selected from the group consisting of:

a glass fiber, a silicon fiber, a calcium magnesium silicate fiber, a mineral fiber comprising $SiO_2$ and CaO, a basalt fiber, a ceramic fiber, stainless steel, and a coated flexible inorganic fiber that have a melting point of higher than 1200° C.

16. The facade assembly according to claim 15, wherein the fire-protection mat is a coated or uncoated textile material.

17. The facade assembly according to claim 16, wherein the textile material comprises at least one material selected from the group consisting of a glass-fiber fabric; a silicone-coated glass-fiber fabric; a fabric of a silicon fiber; a temperature-stabilized glass-fiber fabric; a high-temperature-resistant needled mat; a silicone-coated stainless-steel wire fabric; a mixed fabric made from the said textile material and mixed fibers containing inorganic fibers of boron carbide and silicon nitride.

* * * * *